United States Patent [19]

Jensen

[11] 3,973,616

[45] Aug. 10, 1976

[54] ALIGNMENT DEVICE FOR BI-FOLD DOORS

[76] Inventor: K. S. Jensen, 21620 Summit Road, Los Gatos, Calif. 95030

[22] Filed: June 23, 1975

[21] Appl. No.: 589,336

[52] U.S. Cl. ..... 160/199; 16/1 R; 49/409

[51] Int. Cl.[2] ..... E05D 13/00

[58] Field of Search ..... 16/1, 90; 160/199, 206; 49/409, 410

[56] References Cited

UNITED STATES PATENTS

| | | | |
|---|---|---|---|
| 2,839,776 | 6/1958 | Nelson | 16/1 |
| 2,967,322 | 1/1961 | Hollansworth | 16/1 |
| 3,329,990 | 7/1967 | Johnson, Jr. | 16/1 |
| 3,351,973 | 11/1967 | Lawrence, Jr. | 16/1 |

*Primary Examiner*—Andrew V. Kundrat
*Attorney, Agent, or Firm*—Robert G. Slick

[57] ABSTRACT

An alignment device for bi-fold doors is provided which consists of wedge-shaped members fastened to the bottom of the door. The complimentary wedge-shaped members engage each other and pull the bottom edge of the door into alignment and are substantially invisible from either side of the door.

2 Claims, 4 Drawing Figures

ALIGNMENT DEVICE FOR BI-FOLD DOORS

SUMMARY OF THE INVENTION

Bi-fold or folding doors are frequently used in modern construction and such doors are held by guides at the top, but the bottom edges of the door are unguided. In theory, such doors should be in alignment but as a practical matter, there is always some warpage or other lack of symmetry in the doors so that the unguided bottom edges ordinarily do not line up properly.

A number of attempts have been made in the past to solve this problem such as in U.S. Pat. Nos. 2,839,776, 3,329,990 and 3,351,973. In each instance, an alignment device is provided which protrudes from one side of the door. Thus, the alignment device is only satisfactory for a closet or the like werein only one side of the door is normally visible, and such alignment devices are highly unsightly when used on doors between rooms where both sides of the door will be visible. Other attempts such as in U.S. Pat. No. 2,967,322 provide for concealed alignmet devices, but it is necessary to mortise the alignment device in the door, involving a substantial amount of hand labor.

In accordance with the present invention, a simple alignment device is provided for bi-fold doors which fits on the bottoms of the meeting doors and which are substantially invisible from either side when the doors are closed and very inconspicuous even if the doors are standing open. Further, the device of the present invention can be easily installed using only a screw driver so that a minimum amount of labor and skill are involved in carrying out the invention. Additionally, the alignment device is extremely simple and a single stamping operation using an inexpensive die permits them to be stamped out of flat stock or they may be cast using a simple mold. Since the two pieces which form the alignment device are identical, i.e. 180° rotational images, only a single die or mold is necessary for forming the two pieces.

Additional features and advantages of the invention will be brought out in the balance of the specification.

DESCRIPTION OF THE PREFERRED EMBODIMENTS

Figure 1:
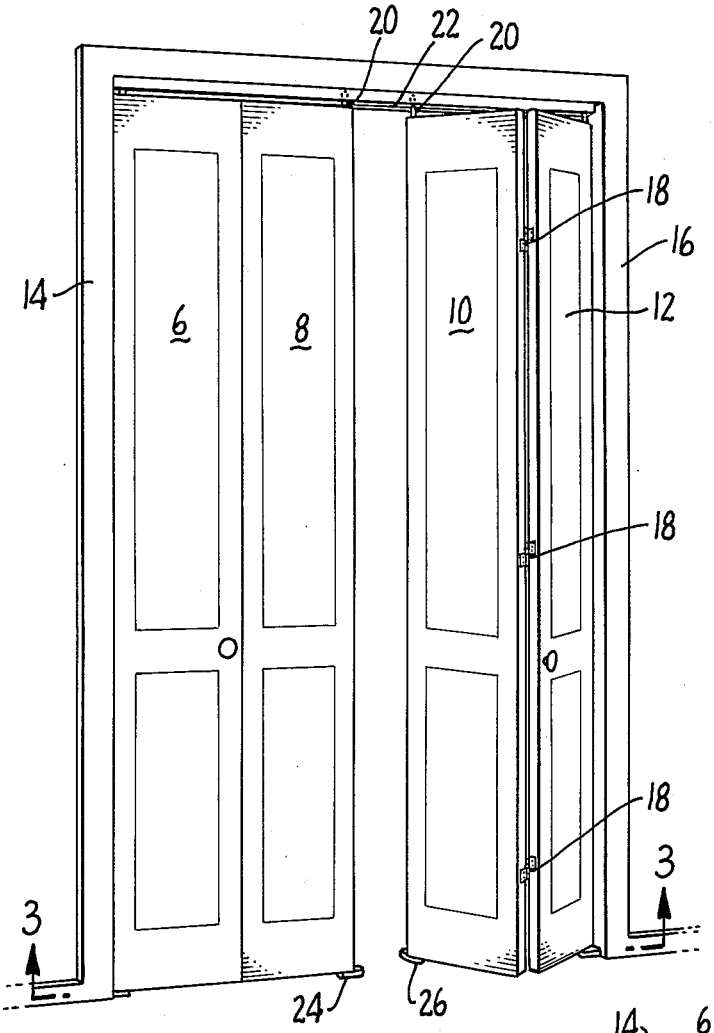
FIG. 1 is a perspective view of a pair of doors embodying the present invention.
Figure 2:
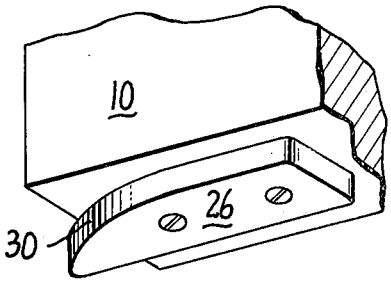
FIG. 2 is an enlarged perspective view of the bottom of a door having a device of the present invention installed thereon.
Figure 3:
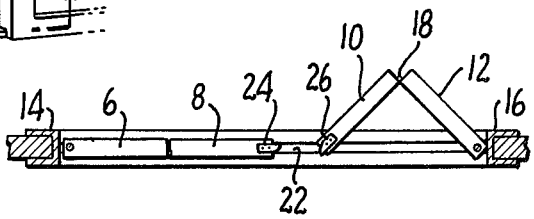
FIG. 3 is a bottom view of a pair of doors, on the line 3—3 of FIG. 1 with the alignment devices of the present invention installed thereon.

Referring now to the drawings by reference characters, there is shown in FIG. 1 a pair of bi-fold doors having panels 6, 8, 10 and 12, the panels 6 being hinged to a frame member 14 and the panel 12 being hinged to a similar frame member 16. Adjacent panels are hinged together so that panels 6 and 8 are hinged together and panels 10 and 12 are hinged together by the hinges 18. The meeting edges of panels 8 and 10 are guided by pins 20 which operate in a track 22 so that the tops of the doors will be held in alignment at all times.

Figure 4:
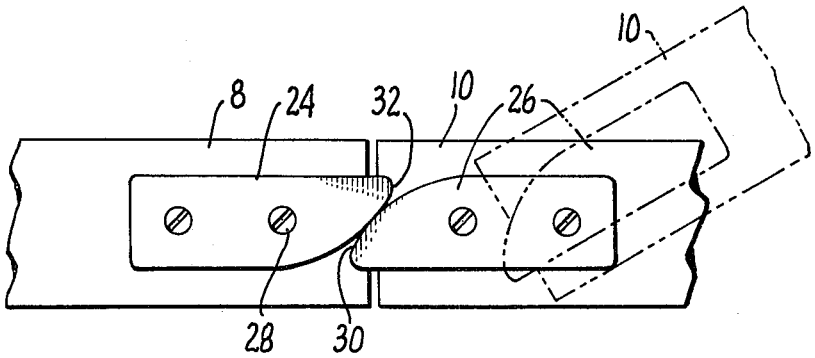
FIG. 4 is an enlarged bottom view of a pair of doors showing the method by which they are brought into alignment.

Due to warpage or other manufacturing defects, such doors invariably do not hang together at the bottom. In accordance with the present invention, a pair of wedge-shaped members designated 24 and 26 are mounted on the bottoms of the meeting panels by means of screws 38 or other suitable means. The members 24 and 26 are identical, except for placement, so only one will be described. Each of the wedge-shaped members has a central face 30 formed at an angle of about 45° to the surface of the door on which it is mounted and is provided with a rounded nose portion 32 so that there are no sharp edges that protrude from the bottom of the door. As is best seen in FIG. 4, the parts are mounted in slightly overlapping relationship so that when the doors are closed, each of the devices slightly overlaps the opposite door.

It is obvious that the device of the present invention will only cure a misalignment in one direction. Accordingly, the installation procedure is that one first installs the doors in a temporary manner and then observes which way the misalignment occurs. Then the devices are mounted on the bottom of the door so that the wedge-shaped members will engage each other and bring the doors into alignmet. Thus, it is obvious from observing FIG. 4 that there is nothing to keep panel 8 from lifting but it is positively prevented from moving downwardly.

Referring again to FIG. 4, the position of the doors are shown where panel 8 is in solid lines and panel 10 is in phantom. Now as the doors are closed, the members 24 and 26 will engage each other as is shown in solid lines and the wedging action of the two parts will bring the doors into perfect alignment.

I claim:

1. An alignment device for the meeting edges of bi-fold doors, wherein the top edge of each door is held on a track and the bottom edge of the mating doors are normally unguided, comprising a pair of wedge-like members which are 180° rotational images of each other and each mounted on a respective under surface of opposed mating doors, said wedges extending partly beyond the bottom corner edge of each door and said wedges bring the doors into alignment as the doors are closed and wedges engage each other.

2. The structure of claim 1 wherein each wedge has a face to engage the face of the opposite wedge, each face being about 45° with respect to the meeting surface of the door and each wedge having a rounded nose portion.

* * * * *